US005551680A

United States Patent [19]

Ohmichi et al.

[11] Patent Number: 5,551,680

[45] Date of Patent: Sep. 3, 1996

[54] SHEET SORTING APPARATUS WITH ROTATING CAM MEMBER

[75] Inventors: Yoshiki Ohmichi; Kuniaki Ishiguro; Kenichi Yasuda, all of Toyokawa, Japan

[73] Assignee: Minolta Co., Ltd., Osaka, Japan

[21] Appl. No.: 390,706

[22] Filed: Feb. 17, 1995

[30] Foreign Application Priority Data

Feb. 23, 1994 [JP] Japan ..... 6-025616

[51] Int. Cl.[6] ..... B42C 1/12; B65H 39/10

[52] U.S. Cl. ..... 270/58.08; 270/58.19; 270/58.28; 271/293

[58] Field of Search ..... 270/53, 58; 271/293

[56] References Cited

U.S. PATENT DOCUMENTS

| | | | |
|---|---|---|---|
| 3,788,640 | 1/1974 | Stemmle | 271/293 |
| 4,512,565 | 4/1985 | Matsumoto et al. | 271/293 X |
| 4,671,505 | 6/1987 | Hidaka | 271/293 |
| 4,681,310 | 7/1987 | Cooper | 271/293 X |
| 4,842,264 | 6/1989 | Kosaka et al. | 271/293 |
| 4,880,223 | 11/1989 | Yamazaki et al. | 271/293 |
| 4,946,152 | 8/1990 | Ishikawa et al. | 270/53 |
| 4,962,920 | 10/1990 | Kitajima et al. | 271/293 |
| 5,024,430 | 6/1991 | Seki et al. | 270/53 |
| 5,050,860 | 9/1991 | Matsuo et al. | 271/293 |
| 5,131,642 | 7/1992 | Yamamoto et al. | 270/53 |
| 5,137,266 | 8/1992 | Mori et al. | 270/53 |
| 5,169,144 | 12/1992 | Aaron | 271/293 |
| 5,236,185 | 8/1993 | Taneda et al. | 270/58 X |
| 5,330,170 | 7/1994 | Uotani et al. | 270/53 |
| 5,351,947 | 10/1994 | Aaron | 271/293 |
| 5,388,819 | 2/1995 | Ushirogata | 270/53 X |
| 5,447,298 | 9/1995 | Watanabe et al. | 270/53 |

FOREIGN PATENT DOCUMENTS

| | | | |
|---|---|---|---|
| 3-99892 | 4/1991 | Japan | 270/53 |
| 5-155176 | 6/1993 | Japan | 270/53 |

*Primary Examiner*—John E. Ryznic

*Attorney, Agent, or Firm*—Willian Brinks Hofer Gilson & Lione

[57] ABSTRACT

A sheet sorting apparatus of a moving bin type for sorting sheets received successively from a sheet delivery station into collated sets, which apparatus comprises. This sheet sorting apparatus includes a plurality of trays stacked one above the other in a vertical direction, and vertically movably supported by a frame structure, first and second camming members extending in a direction parallel to a direction of movement of the trays and having helically continuing threads each having an upwardly oriented camming face engageable with any one of the trays, a sheet delivery mechanism for successively discharching the sheets towards the delivery station, and a drive motor drivingly coupled with the first and second camming members for driving the camming members about respective longitudinal axes of the camming members to move the trays up and down therealong. The helicatly continuing threads is divided into a low pitch region in which each neighboring threads are spaced a small pitch and a high pitch region in which the neighboring threads are spaced an increased pitch. The first and second camming members are so supported with their high pitch regions confronting the sheet delivery station, one of the trays supported on the thread in the high pitch region being permitted.

9 Claims, 9 Drawing Sheets

SHEET SORTING APPARATUS WITH ROTATING CAM MEMBER

BACKGROUND OF THE INVENTION

1. Field of the Invention

The present invention generally relates to a sheet sorting apparatus for use in association with an image forming apparatus such as, for example, a copying machine, for sorting sheets received successively from the image forming apparatus into collated sets and, more particularly, to the sheet sorting apparatus of a moving bin type including a plurality of bins or trays that move past a sheet delivery station which may be coupled with a discharge mouth of the image forming apparatus.

2. Description of the Prior Art

The sheet sorting apparatus for sorting the sheets such as copies discharged from a copying machine into collated sets generally comprises a sheet storage unit including a stack of spaced bins or trays for receiving and supporting respective collated sets of copies, and a sheet delivery unit for receiving the copies from the copying machine and then sorting them onto the bins or trays. The sheet sorting apparatus hitherto known in the art is generally available in two types, a fixed bin type and a moving bin type.

The fixed bin type includes the bins fixed in respective positions and requires the use of the sheet delivery unit that is movable up and down past a series of positions aligned with the respective positions of the bins. The moving bin type includes the bins supported for movement in spaced relation to each other relative to the sheet delivery unit that is fixed in position. The moving bin type is generally recognized advantageous in that it can be assembled in a compact size.

In view of the present invention directed to the sheet sorting apparatus of the moving bin type, reference will be made hereinafter only to the moving bin type for the discussion of the prior art.

In the moving bin type, the sorting apparatus includes at least two elongated upright cam members helically fluted to leave a plurality of helically continued threads and adapted to be driven in unison with each other. The bin-defining trays are supported by the upright cam members for movement up and down during synchronous rotation of the upright cam members. The neighboring trays are spaced a distance corresponding to the pitch between the neighboring helical threads on each of the upright cam members. This type of sorting apparatus is disclosed in, for example. U.S. Pat. No. 3,788,640, issued Jan. 29, 1974, to Stemmle, and No. 4,946,152 issued Aug. 7, 1990, to Ishikawa et al.

In order for the sheet sorting apparatus of the moving bin type to be assembled in a compact size, one desirable method is to reduce the height of the sorting apparatus itself and this may be accomplished by reducing the spacing between each neighboring trays and, hence, the spacing between one of the trays, then held in alignment with the sheet delivery unit for receiving the sheet therefrom, and the tray positioned immediately thereabove. However, undue reduction of the spacing between each neighboring trays tends to make the sheet sorting apparatus susceptible to paper jam.

The different sheet sorting apparatus has been developed which is substantially free from the problem associated with the paper jam and, yet, which is assembled in a compact size. In this different sheet sorting apparatus, arrangement has been made to provide an increased spacing between the neighboring rays only when one of them is brought into alignment with the sheet delivery unit while the reduced spacing is maintained with respect to the other trays out of alignment with the sheet delivery unit. More specifically, in this newly developed sheet sorting apparatus, each of the upright cam members referred to above is formed with a low pitch spiral camming surface region, in which the pitch between each neighboring helical threads is relatively small, and a high pitch spiral camming surface region in which the pitch between the neighboring helical threads is relatively large. The upright cam members employed in this newly developed sheet sorting apparatus are supported with their high pitch spiral camming surface regions confronting the sheet delivery unit so that when one of the trays is brought into alignment with the sheet delivery unit, the spacing between such one of the trays and the trays immediately thereabove can be increased.

Even with the newly developed sheet shorting apparatus, however, it is not possible to completely eliminate the problem associated with the paper jam. Once a paper jam occurs in the sheet sorting apparatus, a jam removal procedure must be exercised to remove one or more sheets jammed between the neighboring trays.

Accordingly, development of a sheet sorting apparatus in which the jam removal procedure can easily be performed has been longed for. Considering that the paper jam is apt to occur at a location adjacent delivery rollers in the sheet delivery unit, it has been desired to develop the sheet sorting apparatus of a type in which the paper jam occurring at portions of the trays adjacent the sheet delivery unit can easily be removed.

It is eventually pointed out that the sheet sorting apparatus has already been developed of a design wherein only a portion of each tray remote from the sheet delivery unit can be manually lifted to spread the spacing between that portion of one tray and that portion of the tray immediately above such one tray. In this new design, the jam removal is possible only when paper jam occurs in a region where the neighboring trays can be spread. However, where the paper jam occurs in a different region adjacent the sheet delivery unit, and since no means is provided to enable the opposite portion of each tray adjacent the sheet delivery unit to be lifted, the problem associated with ease to remove the paper jam is still left unsolved even in this new design.

SUMMARY OF THE INVENTION

Accordingly, the present invention has been devised with a view to substantially eliminating the above discussed problems and is intended to provide an improved sheet sorting apparatus of the moving bin type which is compact in size and, yet, which the jam removal, particularly removal of the paper jam occuring at a location within the sheet sorting apparatus and in the vicinity of the sheet delivery unit, can easily be performed.

To this end, the present invention provides a sheet sorting apparatus of a moving bin type for sorting sheets received successively from a sheet delivery station into collated sets, which apparatus comprises. This sheet sorting apparatus includes a plurality of trays stacked one above the other in a vertical direction and vertically movably supported by a frame structure, first and second camming members extending in a direction parallel to a direction of movement of the trays and having helically continuing threads each having an upwardly oriented camming face engageable with any one of the trays, a sheet delivery mechanism for successively discharging the sheets towards the delivery station, and a drive motor drivingly coupled with the first and second camming members for driving the camming members about respective longitudinal axes of the camming members to move the trays up and down therealong.

The helically continuing threads is divided into a low pitch region in which each neighboring threads are spaced a small pitch and a high pitch region in which the neighboring threads are spaced an increased pitch. The first and second camming members are so supported with their high pitch regions confronting the sheet delivery station, one of the trays supported on the thread in the high pitch region being permitted.

Preferably, each of the first and second camming members are in the form of an elongated cylinder having helically continuing threads formed on an outer peripheral surface of the cylinder and having an upwardly oriented camming face on which he trays rollingly rest to thereby support the trays. In this case, the helically continuing threads are divided into a low pitch region in which each neighboring threads are spaced a small pitch and a high pitch region in which the neighboring threads are spaced an increased pitch. The first and second camming members are so supported with their high pitch regions confronting the sheet delivery station. The second high pitch region is of a size sufficient to allow one of the trays supported on the thread in the high pitch region to be manually upwardly shiftable.

Alternatively, each of the first and second camming members may be in the form of an elongated cylinder having an outer peripheral surface helically fluted to leave helically continuing threads on such outer peripheral surface and which have an upwardly oriented camming face on which the trays rollingly rest to thereby support the trays.

According to the present invention, the spaced trays are moved up and down by rotation of the camming members each having the helically continuing threads which are preferably in the form of square thread. To facilitate the smooth up and down movement of the trays in unison during rotation of the camming member, each tray preferably has roller elements carried thereby so as to protrude laterally outwardly, which roller elements rollingly rest on the associated helically continuing threads.

So long as the camming members are held still without being rotated, the high pitch regions of the respective camming members are aligned with the delivery station and confront with each other and, therefore, any one of the trays then held in alignment with the delivery station can be manually shifted upwardly. This capability of the trays being manually upwardly shifted is a convenient means for facilitating removal of a paper jam occurring in the neighbor of the delivery station and between the neighboring trays one of which is then aligned with the delivery station.

BRIEF DESCRIPTION OF THE DRAWINGS

This and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENT

Figure 1:
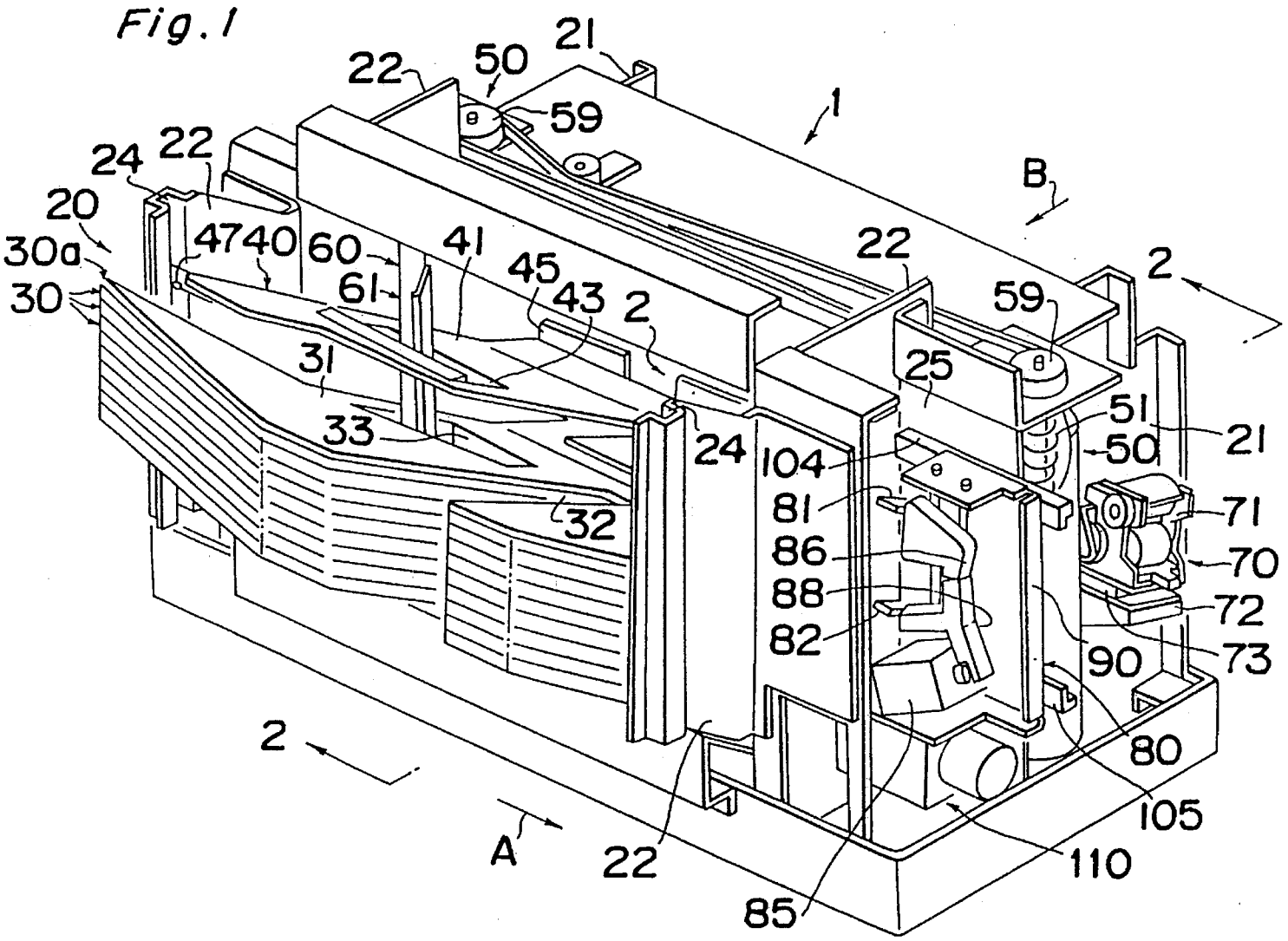
FIG. 1 is a schematic perspective view of a sheet sorting apparatus embodying the present invention.

As shown in FIG. 1, the sheet sorting apparatus herein disclosed in accordance with the present invention generally identified by 1 is assumed to be used in association with a copying machine (not shown) and broadly comprises a delivery unit 10 for receiving successively copied papers from the copying machine, a paper storage unit 20 including a plurality of, for example, ten, vertically movable paper support trays 30 supported one above the other for receiving the copied papers in a collated fashion, a pair of elevators 50 operable in unison with the delivery unit 10 for driving the stack of the trays 30 up and down, an alignment unit 60 for aligning side edges of the sets of collated copied papers on the respective trays 30 in a direction, shown by the arrow A, transverse to the direction of feed of the copied papers from the delivery unit 10 onto the trays 30 as indicated by the arrow B, a stapler mechanism 70 for stapling each collated set of the copied papers on the trays 30, a chucking mechanism 80 for chucking each collated set of the copied papers during the stapling operation performed by the stapler mechanism 70, and a drive unit 110 for driving the chucking mechanism 80.

It is to be noted that the terms "front", "rear", "left" and "right" herein used to show the orientation are to be understood as used in relation to, and as viewed in a direction conforming to, the direction of successive feed of the copied papers from the copying machine onto the sheet sorting apparatus 1 as indicated by the arrow B. Hence, opposite sides of the body of the sheet sorting apparatus 1 adjacent to and remote from the copying machine are referred to as the front and rear sides, respectively, and, also, opposite ends of the body of the sheet sorting apparatus 1 adjacent to and remote from any one of the chucking mechanism 70 and the stapler mechanism 80 are referred to as left and right ends, respectively. With this nomenclature, it will readily be understood that the copied papers successively discharged from the copying machine advances from the front side towards the rear side of the sheet sorting apparatus 1 as indicated by the arrow B.

Figure 2:
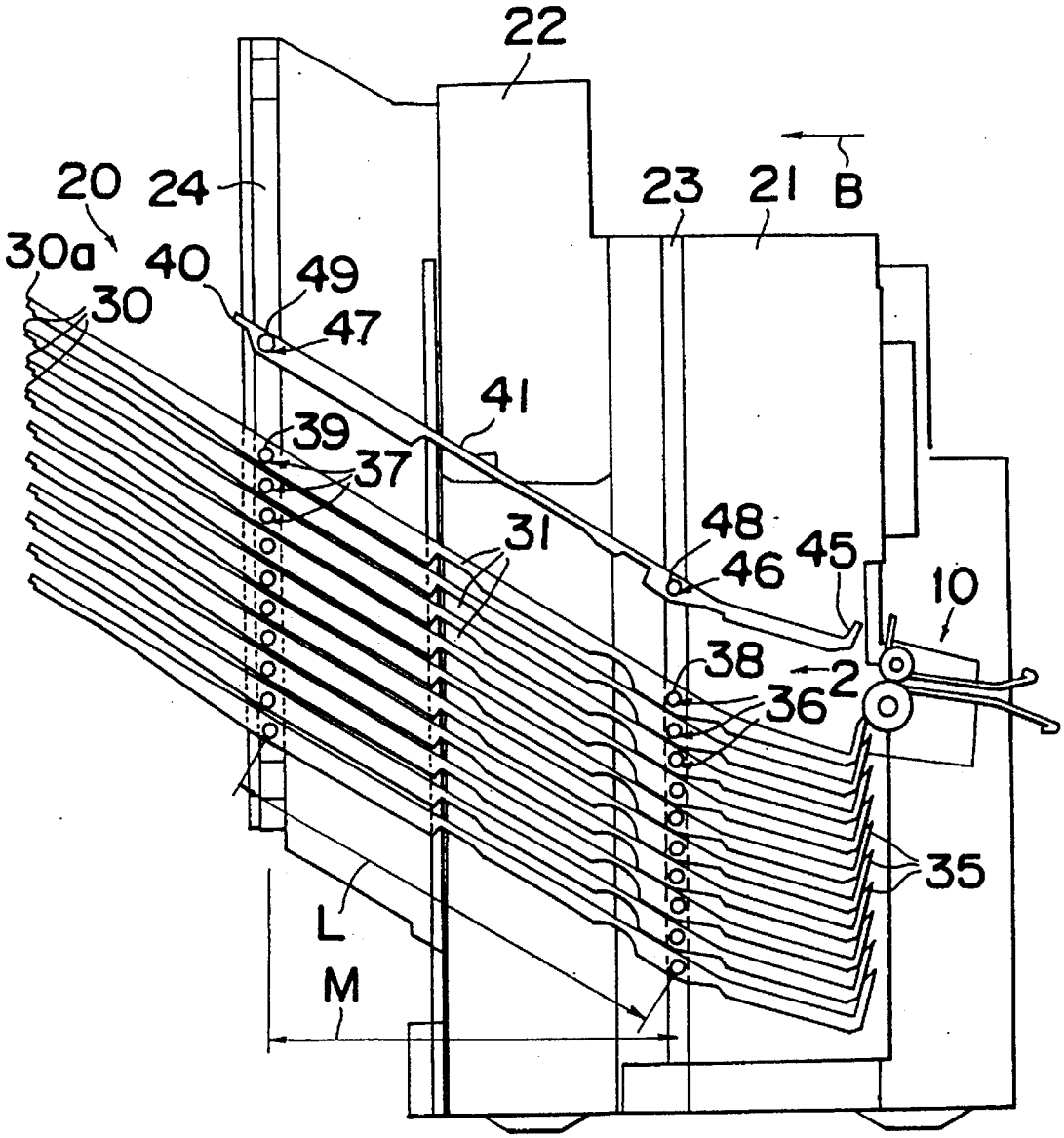
FIG. 2 is a cross-sectional view taken along the line 2—2 in FIG. 1.
Figure 3:
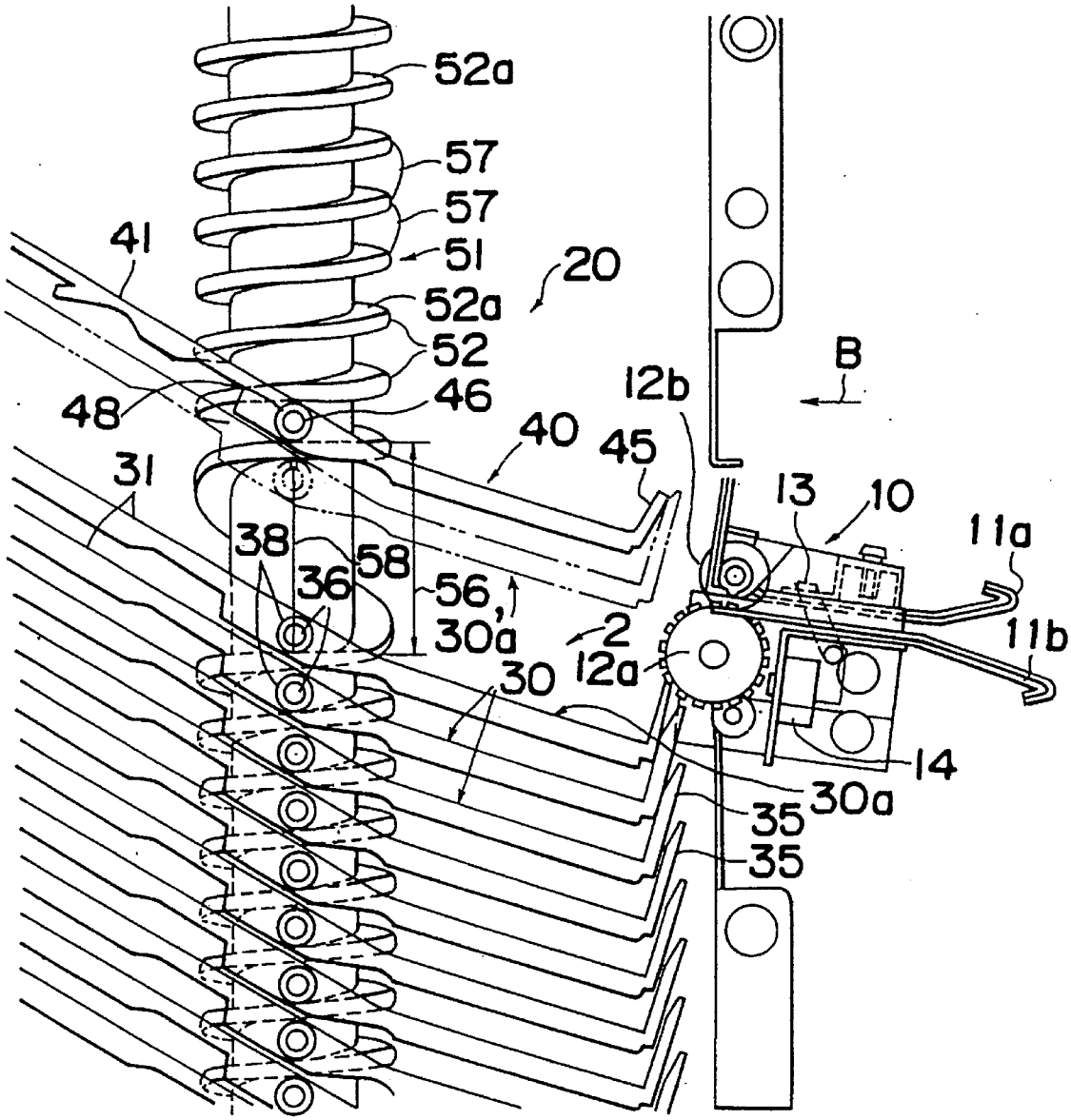
FIG. 3 is a side view of a portion of the sheet sorting apparatus, showing the details of a sheet delivery unit and a sheet storage unit both employed therein.

The delivery unit 10 (not visible in FIG. 1 ) is disposed in a front region of the sheet sorting apparatus 1 and, as best shown in FIGS. 2 and 3, a ribbon of space extending sidewise from left to right within the sheet sorting apparatus 1 and through which the copied papers are successively delivered by the delivery unit 10 into the sheet storage unit 20 is referred to as a delivery station 2. The elevators 50 are disposed at left and right sides of the sheet storage unit 20, and the stapler mechanism 70 and the chucking mechanism 80 are disposed at a left end of the sheet sorting apparatus 1 and at a height generally flush with the delivery station 2. It is to be noted that both of the elevators and the alignment unit 60 are not shown in FIG. 2.

Delivery Unit, Storage Unit, Elevators and Alignment Unit

The details of each of the delivery unit 10 and the sheet storage unit 20 are best shown in FIGS. 2 and 3. As shown therein, the delivery unit 10 includes upper and lower guide members 11*a* and 11*b* for receiving and guiding each copied paper discharged from the copying machine (not show), a pair of delivery rollers 12*a* and 12*b* for feeding the received copied paper in a rearward direction with a nipping region between these rollers 12*a* and 12*b* aligned with the delivery station 2, a drive means (not shown) for driving the delivery rollers 12*a* and 12*b* in respective directions counter to each other, and a paper sensor including a light shielding member 13 and a photo-coupler 14 for detecting passage of each copied paper through a path defined between the upper and lower guide members 11*a* and 11*b*.

With the delivery unit 10 so constructed as described above, the copied papers discharged successively from the copying machine advance one by one through the path between the upper and lower guide members 11*a* and 11*b* and then delivered by the delivery rollers 12*a* and 12*b* onto the trays 30 then positioned one by one in alignment with the delivery station 2 as will be described later. It is to be noted that, at the time each copied paper is delivered onto the associated tray 30 held in alignment with the delivery station 2, the copied paper is generally vigorously ejected rearwardly from the delivery rollers 12*a* and 12*b* for the purpose of minimizing the possibility of occurrence of a paper jam.

Figure 5:
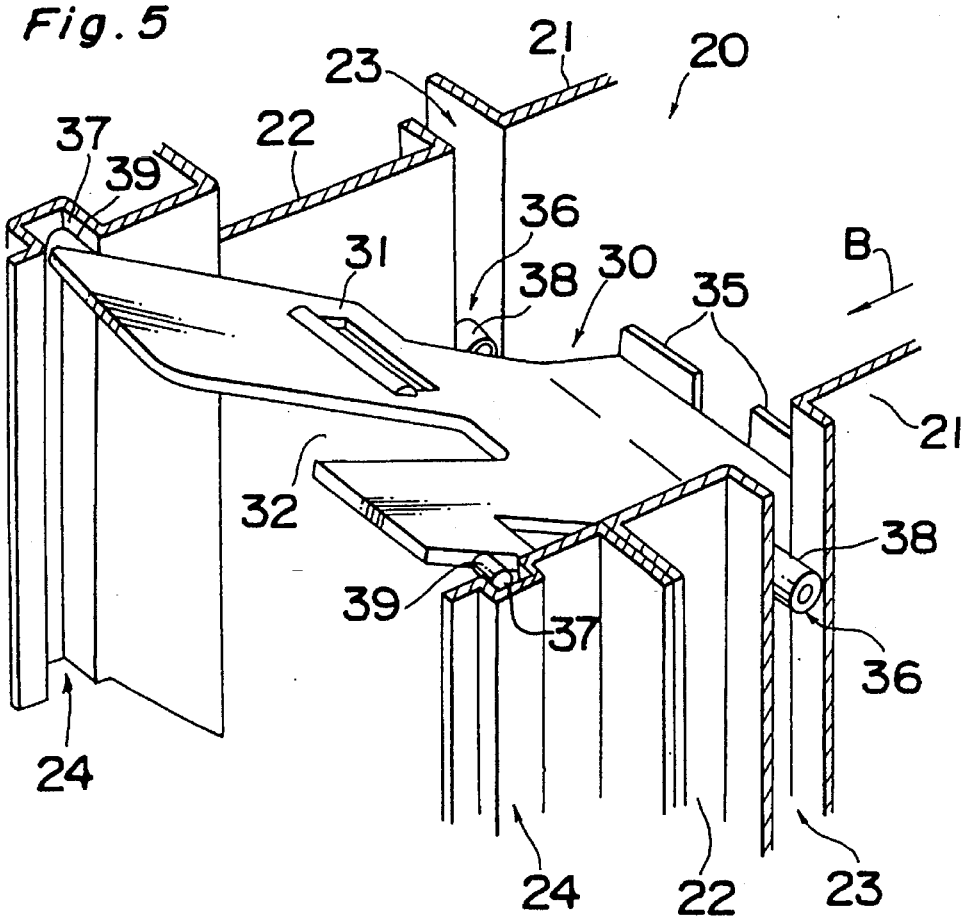
FIG. 5 is a perspective view, on an enlarged scale, of another portion of the sheet sorting apparatus, showing the manner in which one tray is supported for movement vertically.

The sheet storage unit 20 includes, as best shown in FIGS. 1, 2 and 5, front left and right frames 21 disposed in an upright position in opposition to each other, rear left and right frames 22 disposed in an upright position in opposition to each other and located rearwardly of the front left and right frames 21, and a plurality of trays 30 and a single dummy tray 40 both disposed for vertical movement between the front and rear left frames 21 and 22 and the front and rear right frames 21 and 22 with said dummy tray 40 positioned immediately above the uppermost one of the trays 30. All of these trays 30 and 40 are supported in spaced relation to each other so as to incline downwardly towards the front side of the sheet sorting apparatus 1.

The dummy tray 40 referred to above serves four functions of accommodating copied papers discharged from the copying machine when no sorting of the copied papers is needed, of guiding each copied paper from the copying machine onto the uppermost tray 30 immediately therebelow, that is, the uppermost tray 30, of holding each copied paper sorted down onto the uppermost tray 30, and of covering a top space immediately above the uppermost tray 30 to avoid any possible access of an operator's hand to the alignment unit 60.

Figure 4:
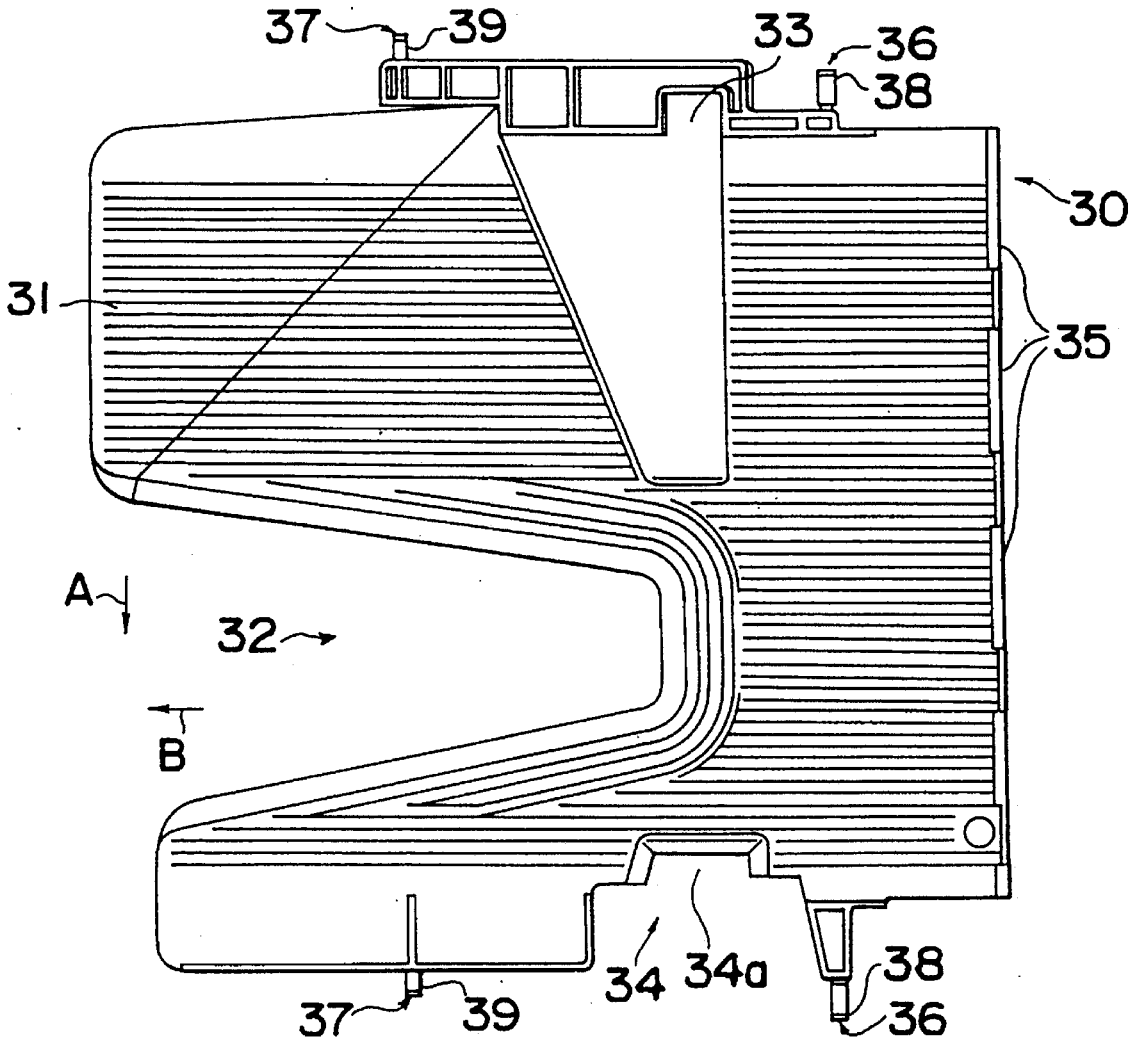
FIG. 4 is a top plan view, on an enlarged scale, showing one of a plurality of trays used in the sheet sorting apparatus.

The trays 30 are of an identical design as shown in FIG. 4 and, in describing the details of each tray 30, reference is therefore made only to one of them. As shown in FIG. 4, the tray 30 is of a generally rectangular shape comprising a generally rectangular plate member 31 having a cutout 32 defined therein so as to extend inwardly thereof from a rear end thereof. This plate member 31 has a left side portion (or a lower edge portion as viewed in FIG. 4) formed with a large recess 34 defined therein so as to extend inwardly thereof for accommodating a reference alignment member 68 (FIGS. 8 and 12) as will be described later and also with a small recess 34*a* extending inwardly from the bottom of the large recess 34 for accommodating a component part of the chucking mechanism 80 as will also be described later. The plate member 31 also has a right side portion (or an upper edge portion as viewed in FIG. 4) formed with a generally triangular opening 33 through which an alignment body 61 of the alignment unit 60 extends, and further has a front end formed with discrete front upright walls 35 for avoiding fall of the copied paper frontwardly from the associated tray 30.

The plate member 31 is formed with front left and right arms 36 and rear left and right arms 37 both protruding from the left and right sides thereof in respective directions away from each other, said front left and right arms 36 and said rear left and right arms 37 being spaced from each other in a direction conforming to the direction B of feed of the copied papers. As will become clear from the later description, the front left and right arms 36 are engaged in respective vertically extending front left and right guide grooves 23 each defined between the front left or right frame 21 and the rear left or right frame 22 while the rear left and right arms 37 are engaged in respective vertically extending rear left and right guide channels 24 defined the rear left and right frames 22. For minimizing the frictional resistance during the vertical movement of the trays 30, roller elements 38 and 39 are rotatably mounted on the front left and right arms 36 and the rear left and right arms 37, respectively.

The dummy tray 40 comprises a plate member 41 substantially identical in construction with each of the trays 30 described above, but having a length smaller than that of each tray 30. Accordingly, as shown in FIG. 2, the plate member 41 forming the dummy tray 40 includes discrete front upright walls 45, front left and right arms 46 having roller elements 48 rotatably mounted thereon, and rear left and right arms 47 having roller elements 49 rotatably mounted thereon. As is the case with any one of the trays 30, this dummy tray 40 is also supported with the roller elements 48 on the front arms 46 and the roller elements 49 on the rear arms 47 slidingly and rollingly engaged in the front guide grooves 23 and the rear guide channels 24.

With the trays 30 and the dummy tray 40 so constructed as hereinabove described, it will readily be seen that the copied paper vigorously discharged rearwardly onto the respective tray slides backwardly along the respective tray until a trailing end of the copied paper with respect to the direction B of feed thereof is brought into abutment with the discrete front upright walls 35 or 45 of the associated tray. Accordingly, the copied papers delivered onto each tray 30 or 40 have their trailing ends aligned with each other in contact with the discrete front upright walls 35 or 45.

As best shown in FIGS. 2 and 5, the front guide grooves 23 each defined between the front left or right frame 21 and the rear left or right frame 22 extend vertically and, similarly, the rear guide channels 24 each defined in the rear left or right frame 22 extend vertically and parallel to the front guide grooves 23. The front guide grooves 23 and the rear guide channels 24 are spaced sidewise from each other in a direction conforming to the feed direction B a distance M smaller than the distance L between the axially aligned front roller elements 38 on the front arms 36 of each tray 30 and 40 and the axially aligned rear roller elements 39 on the rear arms 37 of the tray 30 and 40 so that, in a condition in which the trays 30 and 40 are supported with their left and right roller elements 38 and 39 rollingly received within the guide grooves 23 and the guide channels 24, the trays 30 and 40 incline at an appropriate angle downwardly towards the front side of the sheet sorting apparatus 1. This angle of inclination of the trays 30 and 40 does not vary even during the vertical movement of the stack of the trays 30 and 40.

The left and right elevators 50 referred to hereinbefore are vertically disposed outside the left and right guide grooves 23 with respect to the trays 30 and 40. Each of those elevators 50 accommodates therein an elongated and helically fluted camming member 51 journalled to a frame (not shown) of the respective elevator 50 so as to extend parallel to the adjacent guide groove 23. The camming members 51 have respective pulleys 59 mounted on upper ends thereof for rotation together therewith, said pulleys 59 being drivingly coupled with a drive belt. These camming members 51 are adapted to be driven in one of opposite directions in unison with each other by a suitable reversible drive motor (not shown).

Figure 7:
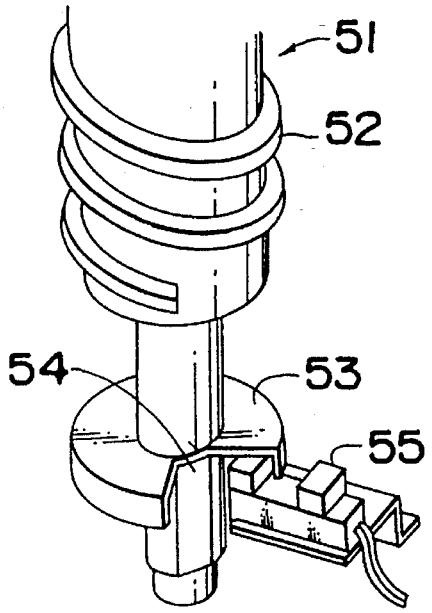
FIG. 7 is a fragmentary perspective view, on an enlarged scale, showing a lower portion of the helically fluted upright camming member shown in FIG. 7 in association with a rotation sensor.
Figure 6:
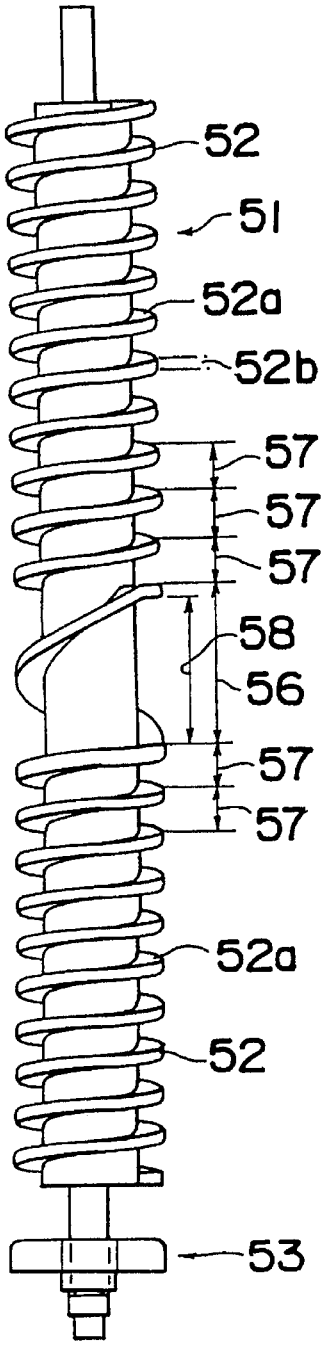
FIG. 6 is a side elevational view of one of helically fluted upright camming members employed in the sheet sorting apparatus.

The details of the camming members 51 are best shown in FIGS. 6 and 7 and, since the both are of identical construction, reference will now be made to only one of the camming members 51 for the sake of brevity. It is to be noted that, in describing the details of each camming member 51, the nomenclature generally used in the art of screws or gears is employed since the respective camming member 51 employed in the present invention resembles in function to an auger shaft.

The camming member 51 is in the form of an elongated cylinder helically fluted to leave, or otherwise integrally formed with, helically continuing threads 52 which are preferably square threads of a thickness **52*b* uniform over the length thereof. This camming member 51 has upper and lower ends formed with a respective stud shaft of a reduced diameter and includes a flanged light shielding disc 53 mounted on the lower stud shaft for rotation together therewith, said light shielding disc 53 forming a part of a rotation detector for detecting the angular displacement of the camming member 51 as will be described later. Each of the helically continuing square threads 52 has upwardly and downwardly oriented cam faces opposite to each other, the upwardly oriented cam face 52*a* being adapted to support thereon the associated roller element 38 on the respective front or rear arm 36 integral with each tray 30 or 40**.

The thickness **52*b* of each square thread 52 is preferably chosen to be relatively small and smaller than the depth of the square thread 52, that is, the radial distance over which each square thread 52 protrudes radially outwardly from the cylindrical body of the camming member 51**.

While a preponderance of the square threads 52 has an equal pitch as indicated by 57, and also has an equal helix angle, only one of the square threads 52 which, in the assembled condition of the sheet sorting apparatus of the present invention and so long as the camming member 51 is held still at a definite position, generally aligns with the delivery station 2 has a helix angle greater than that of the remaining square threads 52 and is spaced an increased pitch, as indicated by 56, from the adjacent square thread to thereby define a high pitch region 58. Thus, it will be seen that the camming member used in the present invention has a low pitch spiral camming surface and a high pitch camming surface defined at a generally intermediate portion of the low pitch camming surface and at that portion of the camming member 51 which generally aligns with the delivery station 2.

While each of the camming members 51 is constructed as hereinabove described, the pitch between each neighboring square threads 52 of the camming members 51 determines the spacing between the neighboring trays 30 or 30 and 40. In other words, each time the camming members 51 undergo one complete rotation about the longitudinal axis thereof, the trays 30 and 40 are vertically shifted, i.e., moved upwardly or downwardly depending on the direction of rotation of the camming members 51, a distance corresponding to the pitch between each neighboring square threads 52 of the camming members 51. Therefore, the presence of the low and high pitch spiral camming surfaces in the camming members 51 allows the spacing between the neighboring trays to be kept minimum as the trays move vertically with the respective roller elements 38 rolling along the low pitch spiral camming surfaces of the respective camming members 51, but to be increased as the trays move vertically with the respective roller elements 38 rolling along the high pitch spiral camming surfaces of the respective camming member 51. Hence, as the trays 30 and 40 successively approach the delivery station 2, any one of the trays positioned above the next adjacent upper or lower tray depending on the direction of rotation of the camming member is vertically shifted an increased distance, determined by the increased pitch 56, to spread the neighboring trays to facilitate receipt of the copied paper onto the lower one of the neighboring trays.

It is to be noted that, so long as the camming members 51 are not driven, the camming members 51 are held in a stop position with their high pitch regions 58 confronting with each other in a direction transverse to the feed direction B and also confronting the front arms 36 and 46 so that the lower one of the trays then aligned with the high pitch regions 58 and hence spaced a maximum distance, determined by the increased pitch 56, from each other can be manually shifted upwardly to provide an increased access opening through which the operator can have an access to the spacing between such lower one of the trays and the tray immediately therebelow.

To allow each of the camming members 51 to be driven from and to the stop position, the rotation detector is employed, the details of which are shown in FIG. 7. As shown therein, the rotation detector includes the light shielding disc 53 rigidly mounted on the lower stud shaft of at least one of the camming member 51 for rotation together therewith, and a photo-coupler 55 fixedly supported by a lower frame (not shown) below the associated elevator 50. The light shielding disc 53 has a cutout defined at 54 and, therefore, the cutout 54 passes across the photo-coupler 55 each time the camming member 51 undergoes a complete rotation about the longitudinal axis thereof. Passage of the cutout 54 is detected by the photo-coupler 55 which issues an electric signal which is utilized to synchronously drive the camming members 51.

FIG. 3 illustrates the condition in which the camming members 51 are held in the stop position with the respective high pitch regions 58 thereof confronting with each other and also confronting the front arms 36 and 46. In this condition, while as hereinbefore described, the front left and right arms 36 of each tray 30 and the front left and right arms 46 of the dummy tray 40 are slidingly engaged in the opposite guide grooves 23 through the associated roller elements 36, the roller elements 36 mounted on the respective front left and right arms 36 and protruding laterally outwardly from the corresponding guide grooves 23 rollingly rest on the helical path defined by the thread faces 52*a*.

Also, in the elevators 50, the rotation detector including the light shielding disc 53 and the photo-coupler 55 controls the camming members 51 so as to cause the latter to assume the stop position each time they undergo one complete rotation. Thus, as discussed above, each time the camming members 51 are brought to the stop position, the respective high pitch regions 58 of the camming members 51 confront with each other and also confront the front arms 36 or 46 fast with the tray 30 or 40.

FIG. 3 also illustrates the condition in which the dummy tray 40 is spaced the maximum distance from the uppermost tray indicated by 30*a* and positioned immediately therebelow. In this condition, and so long as the camming members 51 are held at the stop position based on the signal from the rotation detector including the light shielding disc 53 and the photo-coupler 55 as described above, the uppermost tray 30*a* can be manually shifted parallel and upwardly to a position shown by the phantom line 30*a'* a distance equal to the axial length of the high pitch region 58 less the outer diameter of the roller elements 38. Thus, so long as the camming members 51 are held at the stop position with the high pitch regions 58 confronting with each other, the spacing between the neighboring trays 30 or 30 and 40 which are aligned with the delivery station 2 can be spread to provide the increased access opening to allow the operator to remove the copied papers then jamming at or in the vicinity of the delivery station 2 from between the neighboring trays.

Figure 8:
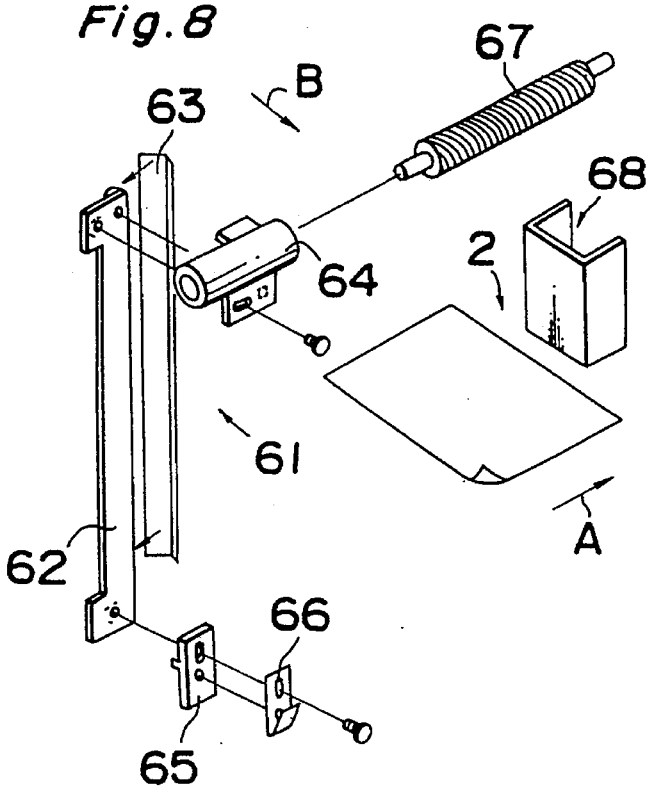
FIG. 8 is a schematic exploded view of an aligning unit used in the sheet sorting apparatus.

FIG. 8 illustrates the details of the alignment unit 60 in an exploded view. As shown therein, and as briefly described hereinbefore, the alignment unit 60 includes the alignment body 61 and the reference alignment member 68. The alignment body 61 is movable towards the left as indicated by the arrow A, i.e., in a direction close towards the reference alignment member 68, to press the copied papers resting on the trays against the reference alignment member 68. Thus, the alignment body 61 and the reference alignment member 68 are operatively supported in position on respective sides of the path of vertical movement of the trays 30 and 40 with respect to the feed direction B while the alignment body 61 extends loosely through the generally triangular openings 33 and 43 defined in the trays 30 and 40 as shown in FIG. 1. Although the reference alignment member 68 is fragmentarily shown as generally held in flush with the delivery station 2, the reference alignment member 68 as well has a length substantially equal to the alignment body 61 so that all of the collated sets of the copied papers resting on some or all of the trays can be simultaneously aligned sidewise in a direction transverse to the feed direction B.

As shown in FIG. 8, the alignment body 61 includes an elongated alignment plate 62 extending vertically, a sheet-like elastic strip 63 affixed to one side edge of the alignment plate 62, an internally helically threaded tubular holder 64 secured to an upper end of the alignment plate 62 to support the latter in a cantilever fashion, a pair of elastic members 65 and 66 secured to a lower end of the alignment plate 62 for avoiding a rattling motion of the alignment plate 62, a screw shaft 67 which threadingly extends through the tubular holder 64 and which when rotated drives the tubular holder 64 and, hence, the alignment plate 62 in a direction left and right, and an alignment drive motor (not shown) drivingly coupled with the screw shaft 67 for driving the screw shaft 67 about the longitudinal axis thereof relative to the tubular holder 64.

Figure 9:
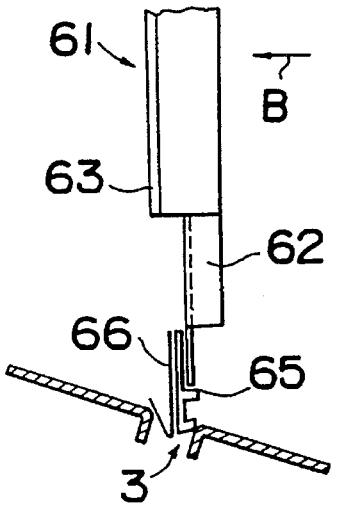
FIG. 9 is a side view showing a lower portion of the aligning unit shown in FIG. 8.

As best shown in FIG. 9 which illustrates a lower end portion of the alignment body 61 as viewed from right, the elastic members 65 and 66 which are joined together and which are in turn secured to the lower end of the alignment plate 62 are engaged in a groove 3 defined at a predetermined site on a lower frame so as to extend in a direction left and right, i.e., in a direction perpendicular to the plane of the sheet of FIG. 9, to thereby avoid any possible oscillatory motion of the alignment plate 62. Considering that the alignment body 61 is initially moved by the rotation of the screw shaft 67, the lower end of the alignment plate 62 may undergo an oscillatory motion as the alignment plate 62 is supported in a cantilever fashion and this oscillatory motion of the alignment plate 62 is effectively suppressed by the engagement of the elastic members 65 and 66 in the groove 3.

As described above, the alignment body 61 employed in the present invention includes only one tubular holder 64 secured to the upper end of the alignment plate 62 while a simple and inexpensive means is provided at the lower end of the alignment plate 62 for avoiding any possible oscillatory motion thereof. Therefore, as compared with the alignment body utilizing two tubular holders on the upper and lower end portions thereof, the sheet sorting apparatus as a whole can advantageously be assembled compact in size.

The alignment plate 62 is normally held at a retracted position prior to the paper alignment being effected. This retracted position is defined at a location spaced from an alignment face of the reference alignment member 68 a distance somewhat greater than the maximum possible width of the papers handled by the sheet sorting apparatus of the present invention. When the paper alignment is to be effected, the alignment plate 62 is moved from the retracted position by the rotation of the screw shaft 67 in a widthwise direction towards the reference alignment member 68, an alignment distance required to allow the alignment plate 62 to be substantially held in contact with right sides of the collated sets of the copied papers. When the alignment plate 62 is so moved the required alignment distance, the elastic strip 63 secured to the alignment plate 62 is held in contact with the right sides of the collated sets of the copied papers to press the latter rightwards with the opposite left sides of the collated sets of the copied papers being consequently aligned against the alignment surface of the reference alignment member 68. It is to be noted that the alignment distance required for the alignment plate 62 to move to accomplish the above described alignment operation is chosen to be slightly greater than the distance required for the collated sets of the copied papers to be displaced sidewise until the left sides of the collated sets of the copied papers are brought into abutment with the alignment face of the reference alignment member 68. With the alignment distance so chosen as described above, the copied papers forming each collated sets on the respective trays can be slightly bowed sidewise to thereby ensure a satisfactory alignment of the opposite sides of the copied papers with respect to each other. During this alignment operation, the elastic strip 63 serves to avoid any possible damage such as, for example, contact marking which would otherwise be left on the right sides of the collated sets of the copied papers when the alignment plate 62 abuts directly against such right sides of the copied papers, and also to accommodate any possible load imposed on the alignment body 61 as a result of the previously described overlap to thereby avoid any possible disorder of the alignment drive motor.

On the other hand, the reference alignment member 68 is fitted to the rear right frame 22 for adjustment in position in the sidewise direction by means of a suitable mechanism not shown and is normally biased by a suitable biasing means, which is not shown, but may be a spring element, towards a predetermined position at which, during the sorting operation, the alignment face contactable with the left sides of each collated set of the copied papers is formed. On the other hand, during the stapling operation as will be described later, the reference alignment member 68 is moved leftwards by a mechanism as will be described later in synchronism with operation of the chucking mechanism 80.

Sheet Sorting Operation

Hereinafter, assuming that copies of text pages of the original, for example, a book are made by the copying machine in a plurality of sets each for the whole text pages, the sorting operation of the sheet sorting apparatus 1 comprising the delivery unit 10, the sheet storage unit 20, the elevators 50 and the alignment unit 60 will be described.

In the initial condition, the uppermost tray 30*a* is held at a position aligned with the delivery station 2 and the screw shaft 67 is then driven to move the alignment plate 62 from the initial position to a reference position determined by the size of each copied paper.

The copied papers from the copying machine are successively fed one by one into the delivery unit 10. As the first one of the copied papers pass through the delivery unit 10, the paper sensor including the light shielding member 13 and the photo-coupler 14 is switched on and off. The copied paper discharged outwardly from the nipping region between the delivery rollers 12*a* and 12*b* is distributed onto the uppermost tray 30*a* and, after the lapse of a predetermined time subsequent to the paper sensor having been switched on, the alignment drive motor is driven to rotate the screw shaft 67 to move the alignment plate 62, then held at the reference position, over the alignment distance towards the left to align the copied paper against the reference alignment member 68. Thereafter, the alignment drive motor is reversed to bring the alignment plate 62 back to the reference position.

After the lapse of a predetermined time subsequent to the paper sensor having been switched on, the drive motor for the camming members 51 is driven to elevate the trays 40 and 30 upwardly. When the camming members 51 complete one complete rotation, the photo-coupler 55 detects passage of the cutout 54 in the light shielding disc 53, causing the drive motor for the camming members 51 to be brought to a halt. Accordingly, the trays 40 and 30 are moved upwardly a distance corresponding to the spacing between the neighboring trays, allowing the tray immediately below the uppermost tray 30*a* to be brought into alignment with the delivery station 2 in readiness for receipt of the next succeeding copied paper from the copying machine.

The foregoing sequence is repeated a number of times equal to the number of the text pages of the original, thereby completing one cycle of sorting of the copied papers of the initial text page.

When the copied papers of the next succeeding text page are to be sorted, the drive motor for the camming members 51 is reversed to rotate the camming members in a direction counter to the direction in which they are rotated when the sorting of the copied papers of the initial text page was to be performed, to lower the trays 40 and 30. With the trays 40 and 30 being lowered, the copied papers of such next succeeding text page are distributed successively onto the trays 30 to rest above the first copied papers, thereby completing the next succeeding cycle of sorting of the copied papers of the next succeeding text page.

This cycle of sorting is repeated until the copied papers of the whole text pages have been distributed onto the trays 30 to form the collated sets of the copied papers. However, it is to be noted that during the odd-numbered sorting cycle, the trays 40 and 30 are moved upwardly while during the even numbered sorting cycle the trays 40 and 30 are moved downwardly, as the camming members 51 are reversed in direction of rotation each time the camming members 51 undergo one complete rotation.

Chucking Mechanism and Stapler Mechanism

As shown in FIG. 1, the stapler mechanism 70 is fixedly supported by the front left frame 21 at a left-hand portion of the sheet sorting apparatus 1 and frontwardly of the left elevator 50. The chucking mechanism 80 is positioned at the left-hand portion of the sheet sorting apparatus 1 and rearwardly of the left elevator 50 and is supported by a side plate 25, protruding leftwardly from the rear left frame 22, for movement in a direction left and right so that, when the chucking mechanism 80 is moved rightwards, a right-hand portion of the chucking mechanism 80 moves through an opening (not shown), formed in the rear left frame 22, to chuck the collated set of the copied papers on the tray 30 then aligned with the delivery station 2. On the other hand, when the chucking mechanism 80 is moved to a right position (i.e., a chucking position), the right-hand portion of the chucking mechanism 80 assumes a position adjacent to and rearwardly of the reference alignment member 68 to engage the reference alignment member 68.

The stapler mechanism 70 is so disposed that, when the chucking mechanism 80 having chucked that collated set of the copied paper on the tray 30 then aligned with the delivery station 2 is moved leftwards, a front left corner of that collated set of the copied papers can be stapled. The front left frame 21 is formed with an paper passageway (not shown) through which the front left corner of that collated set of the copied papers then transported by the chucking mechanism 70 can reach the stapler mechanism 70 through the front left frame 21. The front left corner of that collated set of the copied paper having passed through the paper passageway is subsequently stapled by the stapler mechanism 70.

The stapler mechanism 70 includes a stapler body 71 operable to staple each collated set of the copied papers, a fitting plate 71 for securing the stapler body 71 to the front left frame 21 therethrough, a rubber isolator 73 for absorbing vibrations induced when the stapler body 71 is activated, and a guide member (not shown) for guiding the front left corner of the respective collated set of the copied papers to the chucking position of the stapler body 71, said guide member being fitted to the front left frame 21 in alignment with the paper passageway.

In the vicinity of the guide member, a paper detecting photo-sensor (not shown) is disposed for detecting passage of the collated set of the copied papers when the latter is guided by the guide member to determine whether the collated set of the copied paper is properly guided to a predetermined position at which the stapler body 71 works on the front left corner of that collated set of the copied papers.

Figure 10A:
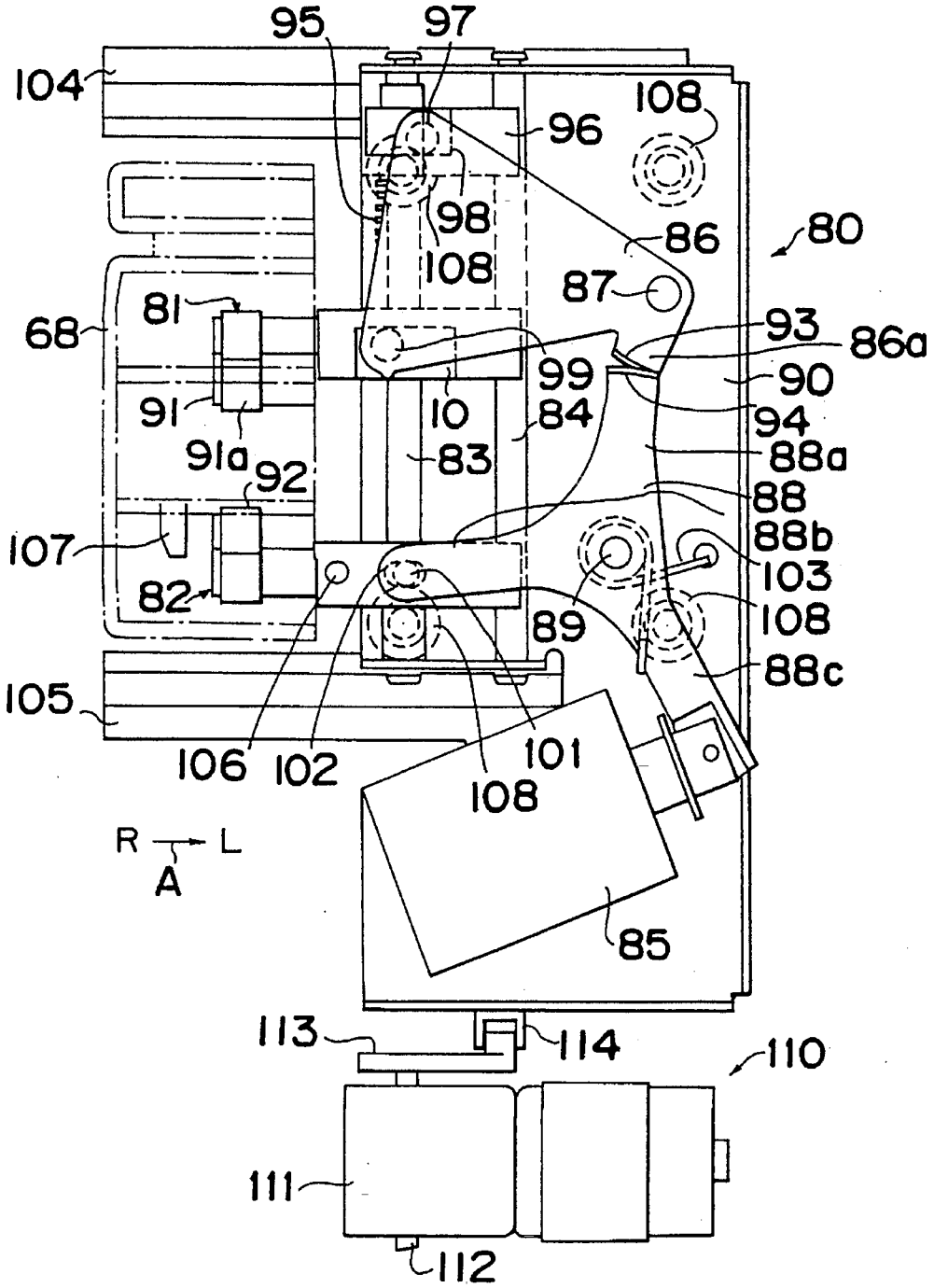
FIG. 10A is a diagram showing a chucking mechanism of the sheet sorting apparatus having been moved leftwards with chucking pawls opened.
Figure 10B:
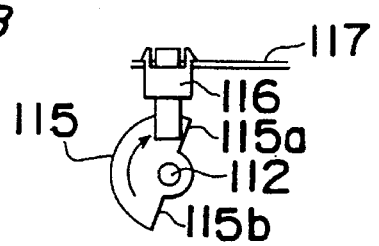
FIG. 10B is a top plan view of a linkage between a drive unit and the chucking mechanism held in one operative position.
Figure 11A:
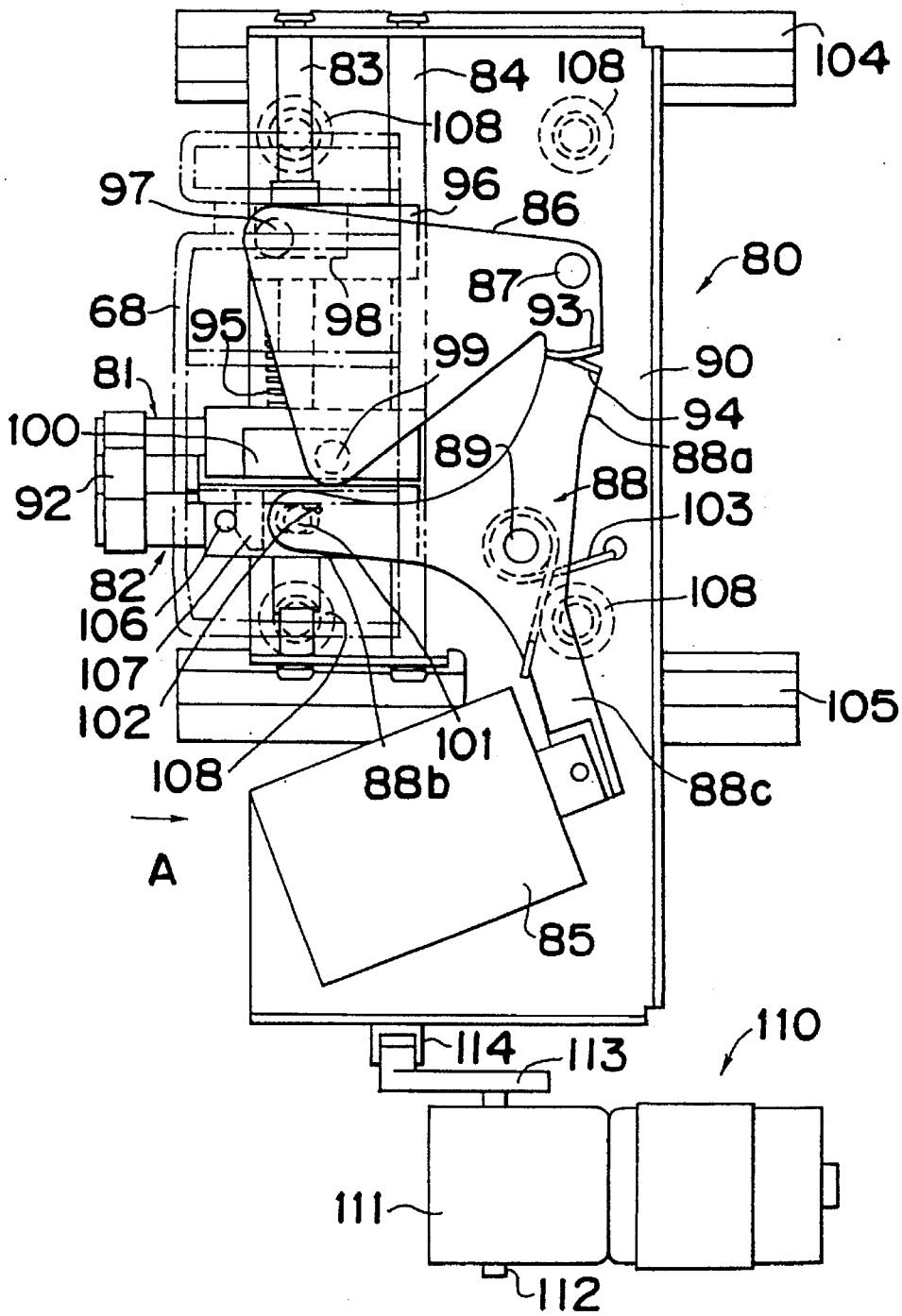
FIG. 11A is a diagram showing the chucking mechanism of the sheet sorting apparatus having been moved rightwards with the chucking pawls closed.
Figure 11B:
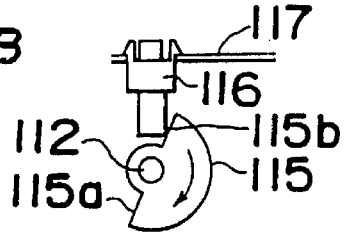
FIG. 11B is a top plan view of the linkage held in a different operative position.

FIGS. 10A and 10B and FIGS. 11A and 11B illustrate the structure and the operation of the chucking mechanism 80 and the drive unit 110. In FIG. 10A, the chucking mechanism 80 is shown as having been moved leftwards with upper and lower chucking pawls 81 and 82 opened (i.e., held in a rest position) and at this time the drive unit 110 is held in such a position as shown in FIG. 10B. In FIG. 11A, however, the chucking mechanism 80 is shown as having been moved rightwards with the upper and lower chucking pawls 81 and 82 closed (i.e., held in a chucking position) and the drive unit 110 is then held in such a position as shown in FIG. 11B.

As shown therein, the chucking mechanism 80 includes the upper and lower chucking pawls 81 and 82 vertically movable for chucking the collated set of the copied papers, a pair of vertically extending parallel guide rods 83 and 84 for guiding the upper and lower chucking pawls 81 and 82 vertically therealong, a solenoid drive 85 for driving the upper and lower chucking pawls 81 and 82, a lower transmission member 88 adapted to be driven by the solenoid drive 85 to pivot to thereby move the lower chucking pawl 82 up and down, an upper transmission member 86 engageable with the lower transmission member 88 and operable to pivot to thereby move the upper chucking pawl 81 up and down in unison with a pivotal movement of the lower transmission member 88, a coiled compression spring 95 for accommodating the thickness of the collated set of the copied paper to permit the latter to be clamped properly, a slider 96 for suppressing the coiled compression spring 95, and a framework 90 for holding those component parts.

The framework 90 has upper and lower pair of roller elements 108 mounted thereon and rollingly engaged on upper and lower rails 104 and 105 secured to the rear left frame 22 so that the chucking mechanism 80 can be moved left and right. The drive unit 110 for moving the chucking mechanism 80 left and right is disposed below the chucking mechanism 80. The chucking pawls 81 and 82 are supported by the upper and lower guide rods 83 and 84 for movement along the guide rods 83 and 84. At a location where respective tips of the chucking pawls 81 and 82 confront with each other, that is, where they contacts the collated set of the copied papers, elastic members 91 and 92 made of a low friction material such as, for example, rubber, are fitted to the respective tips of the chucking pawls 81 and 82.

Although not shown, each of the elastic members 91 and 92 carried by the respective chucking pawls 81 and 82 has a flat engagement face 91*a* or 92*a* engageable with the collated set of the copied paper during the chucking operation. The flat engagement face 91*a* or 92*a* of each elastic member 91 and 92 lies not in a horizontal plane, but is inclined with a front face portion thereof elevated relative to a rear face portion thereof so that no excessive force will be applied to the collated set of the copied papers to be chucked by the chucking pawls 81 and 82. By this design, i.e., with the respective flat engagement faces 91*a* and 91*a* inclined as described above, a relatively large surface area of contact of each chucking pawl with the collated set of the copied paper can be secured for a given size of the respective chucking pawl and, therefore, not only can the chucking of the collated set of the copied paper be achieved effectively, but any possible damages to the collated set of the copied papers can be minimized advantageously.

Actual chucking performed by the chucking pawls 81 and 82 to hold the collated set of the copied papers on the tray 20 takes place within the recess 34*a* in the respective tray 30 then aligned with the delivery station 2.

The right and left guide rods 83 and 84 have their upper and lower ends rigidly secured to the framework 90. The chucking pawls 81 and 82 and the slider 96 are mounted on the guide rods 83 and 84 for vertical movement. Specifically, the left guide rod 83 serves to support the chucking pawls 81 and 82 and the slider 96 so as to permit the latter to move vertically therealong while the left guide rod 84 serve to avoid any jolting motion of those elements. Since the chucking pawls 81 and 82 are adapted to be guided along the two guide rods 83 and 84, the chucking pawls 81 and 82 can maintain their parallel relationship with each other and can be smoothly moved vertically without being twisted relative to each other.

The coiled compression spring 95 is mounted on the right guide rod 83 while interposed between the slider 96 and the upper chucking pawl 81 to apply respective biasing forces to the slider 96 and the upper chucking pawl 81 to urge them away from each other. In other words, the coiled compression spring 95 causes the slider 96 to contact a round pin 97 rigid with the upper transmission member 86 to urge the latter upwardly and, on the other hand, causes the upper chucking pawl 81 to contact a round pin 99 to urge the latter downwardly. Thus, since the coiled compression spring 95 is disposed along the right guide rod 83, the biasing force acting therefrom on the upper chucking pawl 81 acts in a direction along and parallel to the right guide rod 83 and, therefore, the friction between the right guide rod 83 and the upper chucking pawl 81 is minimized to facilitate a smooth movement of the upper chucking pawl 81 along the guide rods 83 and 84.

The upper transmission member 86 is of a generally triangular configuration having left, top right and bottom left corners corresponding in position to the respective apexes of the shape of a triangle and is pivotally supported by the framework 90 with the left corner thereof mounted on a pivot pin 87 rigid with the framework 90. In this condition, the top right corner and the bottom right corner of the upper transmission member 86 are engaged with the slider 96 and the upper chucking pawl 81, respectively, so that upon pivotal motion of the upper transmission member 86, the slider 96 and the upper chucking pawl 81 can be moved up and down. This upper transmission member 86 is formed with a short arm 86*a* so as to extend downwardly from the pivot pin 87, said short arm 86*a* having a lower end formed with a threaded portion 93 for engagement with the lower transmission member 88.

The top right corner of the upper transmission member 86 is formed with the round pin 97 protruding laterally thereof, and the top right corner of the upper transmission member 86 and the slider 96 are engaged with each other with the round pin 97 engaged in a groove 98 defined in an upper surface of the slider 96. Also, The top right corner of the upper transmission member 86 is formed with the round pin 99, and the top right corner of the upper transmission member 86 and the upper chucking pawl 81 are engaged with each other with the round pin 99 engaged in a groove 100 defined in the undersurface of the upper chucking pawl 81. Therefore, when the round pins 97 and 99 are shifted upwardly as a result of the pivot of the upper transmission member 86, the round pin 99 presses the lower chucking pawl 82 downwardly and, on the other hand, the slider 96 then biased upwardly by the coiled compression spring 95 is also shifted upwardly. When the round pins 97 and 99 are, however, moved downwards as a result of the pivot of the upper transmission member 86, the round pin 99 presses the slider 96 downwardly and, on the other hand, the lower chucking pawl 92 then biased downwardly by the coiled compression spring 95 is also shifted downwardly.

The lower transmission member 88 is pivotally secured at a center portion to a pivot pin 89 rigid with the framework 90 and has three arms 88*a*, 88*b* and 88*c* protruding upwardly, rightwardly and downwardly therefrom. The upwardly extending arm 88*a* has a free end formed with a threaded portion 94 for engagement with the threaded portion 93 of the upper transmission member 86. By the meshed engagement between the threaded portions 93 and 94, the upper and lower transmission members 86 and 88 are pivotable in respective directions counter to each other.

The rightwardly extending arm 88*b* has a free end formed with a round pin 101 so as to protrude laterally therefrom. This round pin 101 is engaged in a horizontally extending slot 102 defined in a rear side portion of the lower chucking pawl 82, thereby permitting the lower transmission member 88 to be engaged with the lower chucking pawl 82. It will therefore be understood that the pivotal movement of the lower transmission member 88 results in a vertical shift of the round pin 101, accompanied by a corresponding vertical movement of the lower chucking pawl 82.

The downwardly extending arm 88*c* has a free end drivingly coupled with the solenoid drive 85 so that, when the solenoid drive 85 is turned on, the downwardly extending arm 88*c* is pulled to cause the lower transmission member 88 to rotate in a direction (i.e., clockwise as viewed in FIG. 10A) required to shift the round pin 99 upwardly. Accordingly, when the solenoid drive 85 is turned on, the lower chucking pawl 82 is shifted upwardly, accompanied by a downward shift of the upper chucking pawl 81 through the upper transmission member 86 operatively associated with the lower transmission member 88, and the upper and lower chucking members 81 and 82 are consequently closed as shown in FIG. 11A.

The lower transmission member 88 is normally biased by a torsion spring 103, mounted around the pivot pin 89, with the round pin 101 consequently shifted downwardly, i.e., counterclockwise as viewed in FIG. 10. In other words, the lower chucking pawl 82 is biased downwardly by the torsion spring 103, accompanied by an upward shift of the upper chucking pawl 81 by means of the meshed engagement between the lower transmission member 88 and the upper transmission member 86. Accordingly, when the solenoid drive 85 is turned off, the upper and lower chucking pawls 81 and 82 are opened by the biasing force of the torsion spring 103 as shown in FIG. 10A.

The chucking mechanism 80 includes a mechanism which operates, during the chucking operation, to retract the collated set of the copied papers, which has been stapled and resting on the tray 30 immediately below the tray 30 aligned with the delivery station 2, to a position out of the range in which the lower chucking pawl 82 operates, which mechanism will be described later.

In the chucking mechanism 80 of the construction described above, when and so long as the upper and lower chucking pawls 81 and 82 are closed to chuck the collated set of the copied papers, the upper and lower transmission members 86 and 88 are so positioned relative to each other that, as shown in FIG. 11A, the round pins 99 and 101 approach to each other. In this condition, the upper chucking pawl 81 is held in position pressed upwardly by the collated set of the copied papers then chucked, and the upper chucking pawl 81 is separated from the round pin 99 a distance depending on the thickness of the collated set of the copied papers then being chucked. Accordingly, where as shown in FIG. 11A, the thickness of the collated set of the copied papers being chucked is small, the upper chucking claw 81 is closer to the lower chucking claw 82, but where it is great, the upper chucking pawl 81 is shifted further upwardly therefrom.

At this time, the coiled compression spring 95 having its upper end retained by the slider 96 accommodates the thickness of the collated set of the copied papers, and the biasing force acting from the coiled compression spring 95 on the upper chucking pawl 81 so as to bias the latter downwardly serves the force necessary for the upper and lower chucking pawls 81 and 82 to hold the collated set of the copied papers therebetween. Accordingly, by adjusting the biasing force exerted by the coiled compression spring 95, the chucking force can be adjusted.

The drive unit 110 includes a drive motor 111 having a drive shaft 112 and secured to the side plate 25 with the drive shaft 112 oriented vertically, a cam 113 mounted on an upper end of the drive shaft 112 for rotation together therewith, and a cam slider 114 secured to the undersurface of the framework 90 so as to extend in a direction conforming to the feed direction B, i.e., in a direction perpendicular to the plane of the sheet of FIG. 10A. The cam 113 and the cam slider 114 are operatively engaged with each other and altogether constitute a cam mechanism for translating a rotary motion of the drive motor 111 into a horizontal reciprocating motion of the framework 90. Thus, it will readily be seen that, when the drive motor 111 is activated, the chucking mechanism 80 moves towards a left position as shown in FIG. 10A or towards a right position as shown in FIG. 11A depending on the direction of rotation of the drive motor 111. The chucking mechanism 80 when moved to the right position performs the chucking to hold the collated set of the copied papers between the upper and lower chucking pawls 81 and 82, but when moved to the left position, it is held at the rest position. With the chucking mechanism 80 held at the rest position as shown in FIG. 10A, the stapling operation may take place.

Although not shown in FIG. 10A, the drive shaft 112 of the drive motor 111 has a lower end operatively associated with a rotation detecting mechanism for detecting the rotation of the drive shaft 112. This rotation detecting mechanism is shown in FIGS. 10B and 11B.

The rotation detecting mechanism for detecting the rotation of the drive shaft 112 includes, as shown in FIGS. 10B and 11B, a semicircular light shielding plate 115 mounted on the lower end of the drive shaft 112 for rotation together therewith, and a photo-sensor 116 mounted on a frame 117 in the vicinity of the light shielding plate 115. Each time the drive shaft 112 undergoes half a complete rotation, and shortly before the cam 113 is oriented rightwards or leftwards, either one of opposite edges 115*a* and 115*b* of the light shielding plate 115 passes across the photo-sensor 116 to detect the timing at which the edge 115*a* or 115*b* has passed across the photo-sensor 116. By controlling the drive motor 111 so as to be turned on and off in response to the detection performed by the rotation detecting mechanism, the drive unit 110 drives the chucking mechanism 80 towards the right position or towards the left position.

Hereinafter, the mechanism of sidewise movement of the reference alignment member 68 in response to the movement of the chucking mechanism 80 will now be described.

In FIGS. 10A and 11A, a fragmentary portion of the reference alignment member 68 aligned with the delivery station 2 is shown by the phantom line. As shown therein, the lower chucking pawl 82 is provided with a round pin 106 protruding frontwardly, i.e., in a direction perpendicular to the plane of the sheet of FIG. 10A. On the other hand, the reference alignment member 68 is formed with a downwardly oriented projection 107 which is brought into engagement with the round pin 106 when the lower chucking pawl 82 is moved upwardly (that is, when the lower chucking pawl 82 cooperates the upper chucking pawl 81 to chuck the collated set of the copied papers) while the reference alignment member 68 is held at the position defining the alignment face and, as the same time, the chucking mechanism 80 is moved to the right position. FIG. 10A also illustrates a condition immediately after the round pin 106 and the projection 107 have been engaged with each other.

As described hereinabove, the reference alignment member 68 is supported for movement sidewise and is biased by the biasing member (not shown) to assume the position at which the alignment face is formed. Therefore, when the lower chucking pawl 82 is moved leftwards against the biasing force of the biasing member while the round pin 106 rigid with the lower chucking pawl 82 is engaged with the projection 107, the reference alignment member 68 is also moved sidewise together with the lower chucking pawl 82. In this way, as the chucking mechanism 80 is moved leftwards while chucking the collated set of the copied papers, the reference alignment member 68 is also moved together with the lower chucking pawl 82. As a result of this movement of the reference alignment member 68, the collated set of the copied papers held between the upper and lower chucking pawls 81 and 82 can be guided towards the stapler mechanism 70.

Also, when the upper and lower chucking pawls 81 and 82 are opened while the round pin 106 rigid with the lower chucking pawl 82 is engaged with the projection 107, the round pin 106 is disengaged from the projection 107, allowing the reference alignment member 68 to return by the action of the biasing force of the biasing member to the position where the alignment face is formed.

The mechanism which operates, during the chucking operation, to retract the collated set of the copied papers, which has been stapled and resting on the tray 30 immediately below the tray 30 aligned with the delivery station 2, to a position out of the range in which the lower chucking pawl 82 operates, will now be described.

The sheet sorting apparatus 1 according to the present invention is so designed that, when the collated sets of the copied papers are stapled or bound together by means of a staple needle, the stapling can be effected to the collated sets of the copied papers in the order from the collated set of the copied papers accommodated in the lowermost bin, that is, resting on the lowermost one of the trays 30, to the collated set of the copied papers accommodated in the uppermost bin. For this purpose, each time one collated set of the copied papers is stapled, the camming members 51 of the elevators 50 undergo one complete rotation to descend the trays 30 and the dummy tray 40 a distance of one bin to allow the stapling operation to be performed on the collated sets of the copied papers successively.

Figure 12:
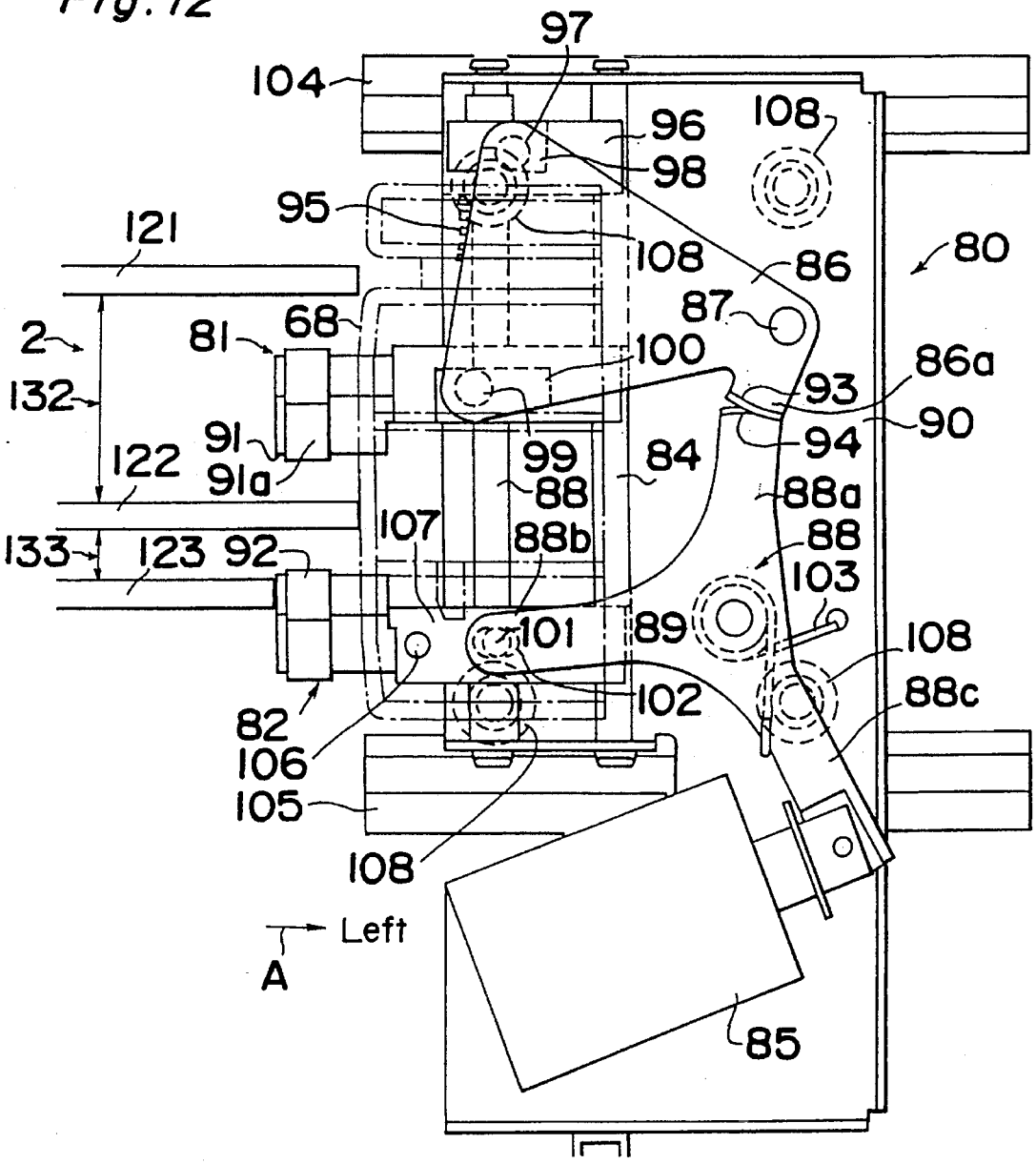
FIG. 12 is a diagram similar to FIG. 10A, showing the sheet chucking mechanism held in position to hold a stack of sheet while allowing sheets therebelow to be retracted.

FIG. 12 illustrates a condition in which when the chucking mechanism 80 is ready to chuck the respective collated set of the copied papers, one of the trays 30 immediately beneath the tray accommodating such collated set of the copied papers is retracted. In this condition, the chucking mechanism 80 is held at a right position with the chucking pawls 81 and 82 opened. The collated set of the copied papers indicated by 122 in FIG. 11 represents a collated set of the copied papers resting on one of the trays 30 then held in alignment with the delivery station 2 and, in this condition, the chucking pawls 81 and 82 are held in position ready to chuck such collated set of the copied papers 122. Another collated set of the copied papers indicated by 121 represents a collated set of the copied papers resting on the tray 30 immediately above the tray 30 accommodating the collated set of the copied papers 122, whereas a further collated set of the copied papers indicated by 123 represent a collated set of the copied papers resting on the tray 30 immediately below the tray 30 accommodating the collated set of the copied papers 122 and having been already stabled.

As shown in FIG. 12, the collated sets of the copied papers 122 and 121 are spaced one above the other by means of a large space 132, while the collated sets of the copied papers 122 and 123 are spaced one above the other by means of a narrow space 133. The large space 132 has a width substantially equal to the difference between the spacing between the neighboring trays 30 then aligned with the delivery station 2 and the thickness of the collated set of the copied papers 122, while the narrow space 133 has a width substantially equal to the difference between the spacing between the neighboring trays 30 not aligned with the delivery station 2 and the thickness of the collated set of the copied papers 123. When the chucking mechanism 80 chucks the collated set of the copied papers 122, a free end of the upper chucking pawl 81 is inserted into the large space 132 as shown.

Accordingly, the width of the large space 132 as measured in the vertical direction is so chosen as to permit the free end of the upper chucking pawl 81 to be selectively inserted thereinto and retracted therefrom. Since the large space 132 has a width that is chosen in consideration of the width of the increased pitch 56 and the thickness of the collated set of the copied papers 122, it is easy to select the distance of movement of a free end of the upper chucking pawl 81.

Thus, the round pins 98 and 99 secured to the upper transmission member 86, the position of the pivot pin 87, the length of the short arm 86*a*, the respective lengths of the three arms 88*a* to 88*c* secured to the lower transmission member 88, and the stroke of the solenoid unit 85 are so chosen and so determined that when the chucking pawls 81 and 82 are opened, the upper chucking pawl 81 can be held at a height ready to be inserted into the large space, and that when the chucking pawls 81 and 82 are opened, the free end of the lower chucking pawl 82 can be held at a height at which it can be engaged with the collated set of the copied papers 123. Also, the free end of the lower chucking pawl 82 has an appropriate width, as measured in the vertical direction, sufficient to push the collated set of the copied papers 122.

Considering the chucking mechanism 80 having the foregoing features, when the drive unit 110 drives the chucking mechanism 80 in the rightward direction while the chucking pawls 81 and 82 are opened, the free end of the upper chucking pawl 81 is received within the large space 132 and, at the same time, the free end of the lower chucking pawl 82 is brought into engagement with the collated set of the copied papers 123, causing the collated set of the copied papers 123 to be shifted rightwards as shown in FIG. 12. This rightward shift of the collated set of the copied papers 123 as described above is to retract the collated set of the copied papers 123 to a position out of the range in which the lower chucking pawl 82 operates to chuck the collated set of the copied papers 122.

Where the width of the narrow space 133 as measured in the vertical direction is extremely small, and if the stapled collated set of the copied papers is accommodate on the tray 30 immediately below the tray 30 accommodating the collated set of the copied papers 123, it is possible to cause the lower chucking pawl 82 to retract both of the collated set of the copied papers 123 and the collated set of the copied papers immediately therebelow. In such case, the free end of the lower chucking pawl 82 should have a width required for the free end of the lower chucking pawl 82 to engage two or more collated sets of the copied papers. Accordingly, the width of the free end of the lower chucking pawl 82 may not be limited by the width of the narrow space 133 and may be conveniently chosen.

Chucking and Stapling Operation

The chucking and stapling operations performed by the sheet sorting apparatus 1 of the above described construction will now be described.

After the sorting, the drive motor for the camming members 51 is energized to drive the lowermost one of the trays 30, then accommodating the collated set of the copied papers, to a position aligned with the delivery station 2. Thereafter, the drive motor 111 is driven to move the chucking mechanism 80 to the chucking position. Subsequent energization of the solenoid unit 85 results in the chucking pawls 81 and 82 to chuck the collated set of the copied papers on the lowermost tray 30 and, while the collated set of the copied papers on the lowermost tray 30 is thus chucked between the chucking pawls 81 and 82, the drive motor 111 is driven to move the chucking mechanism 80 to the left position (stapling position). At this time, the reference alignment member 68 is engaged with the chucking mechanism 80 which is then moved leftwards together with the collated set of the copied papers.

In the event that the paper detecting photo-sensor detects that there is the collated set of the copied papers guided to the predetermined position at which the stapler body 71 performs the stapling operation on such collated set of the copied papers, the stapler mechanism 70 is activated to stable the collated set of the copied papers.

After the stapling of the collated set of the copied papers, the drive motor 111 is again driven to move the chucking mechanism 80 rightwards to the chucking position, followed by deenergization of the solenoid unit 85 to open the chucking pawls 81 and 82. At this time, the collated set of the copied papers which has been stapled is accommodated on the original tray 30 where it has been accommodated, and the reference alignment member 68 is returned by the biasing force of the biasing members to the position where the alignment face is formed. Subsequent thereto, the drive motor 111 is driven to move the chucking mechanism 80 leftwards to the ready position, thereby completing a cycle of stapling one collated set of the copied papers with respect to the lowermost tray 30.

When the collated set of the copied papers accommodated on the tray 30 immediately above the lowermost tray 30 is to be stapled, the foregoing cycle is repeated y rotating the camming members 51 of the respective elevators 50 through 360 degrees to allow the trays 30 and the dummy tray 40 to descend a distance corresponding to the spacing between the neighboring trays.

Rightward movement of the chucking mechanism 80 during the chucking operation causes the lower chucking pawl 82 to push the collated set of the copied papers, then resting on the tray immediately below the tray aligned with the delivery station 2, to engage and move the collated set of the copied papers rightwards. As the collated set of the copied papers so pushed, a space required for the lower chucking pawl 82 to perform the chucking operation in cooperation with the upper chucking pawl 81 can be secured (See FIG. 16).

A similar cycle is effected to the collated set of the copied papers resting on the third and so forth tray 30, and all of the collated sets of the copied papers resting on the other trays are successively stapled.

As hereinabove described, with the sheet sorting apparatus of the present invention, it is possible to manually shift the tray, then aligned with the delivery station, upwardly to provide an access opening when the camming members are held still. Therefore, it is clear that removal of the paper jam occurring in the tray in the vicinity of the delivery station can readily be accomplished. Also, since upward parallel shift of one of the trays then aligned with the delivery station results in a corresponding upward shift of the front portion of such tray, one or more copied papers jammed in the vicinity of the delivery station can also be easily removed.

Although the present invention has been described in connection with the preferred embodiments thereof with reference to the accompanying drawings, it is to be noted that various changes and modifications are apparent to those skilled in the art. By way of example, although each of the camming members 51 has been described as employed in the form of an elongated cylinder helically fluted to leave, or otherwise integrally formed with, helically continuing square threads each having a thickness uniform over the length thereof, the specific configuration of the respective camming member employable in the practice of the present invention may not be always limited thereto. Any camming members helically fluted to leave helically continuing threads of any shape effective to define an upwardly oriented helical path and also having the high pitch region at a portion thereof confronting the delivery station may be employed even though the thickness of the helically continuing threads and the cross-sectional shape thereof vary over the length of the respective camming member.

Accordingly, such changes and modifications are to be understood as included within the scope of the present invention as defined by the appended claims, unless they depart therefrom.

What is claimed is:

1. A sheet sorting apparatus of a moving bin type for sorting sheets received successively from a sheet delivery station into collated sets, which apparatus comprises:

a plurality of trays stacked one above the other in a vertical direction;

a frame structure by which the trays are vertically movably supported;

first and second camming members extending in a direction parallel to a direction of movement of the trays, each of said first and second camming members having helically continuing threads each having an upwardly oriented camming face engageable with any one of the trays;

a sheet delivery mechanism for successively discharging the sheets towards the delivery station;

a drive motor drivingly coupled with the first and second camming members for driving the camming members about respective longitudinal axes of said camming members to move the trays up and down therealong;

said helically continuing threads being divided into a low pitch region in which each neighboring threads are spaced a small pitch and a high pitch region in which the neighboring threads are spaced an increased pitch, said first and second camming members being so supported with their high pitch regions confronting the sheet delivery station, one of the trays supported on the thread in the high pitch region being permitted to be manually upwardly shiftable.

2. The sheet sorting apparatus as claimed in claim 1, wherein each of said trays includes first and second roller elements carried thereby so as to protrude laterally from opposite sides of the respective tray, said roller elements rollingly resting on the helically continuing threads of the first and second camming members, respectively.

3. The sheet sorting apparatus as claimed in claim 1, further comprising a stapler mechanism for binding the sheets in each collated set together and a chucking mechanism for holding the respective collated set of the sheets to allow the stapler mechanism to staple the collated set of the sheets.

4. A sheet sorting apparatus of a moving bin type for sorting sheets received successively from a sheet delivery station into collated sets, which apparatus comprises:

a plurality of trays stacked one above the other in a vertical direction;

a frame structure by which the trays are vertically movably supported;

first and second camming members extending in a direction parallel to a direction of movement of the trays, each of said first and second camming members being in the form of an elongated cylinder having helically continuing threads formed on an outer peripheral surface of the cylinder, each of said helically continuing threads having an upwardly oriented camming face on which the trays rollingly rest to thereby support the trays;

a sheet delivery mechanism for successively discharging the sheets towards the delivery station;

a drive motor drivingly coupled with the first and second camming members for driving the camming members about respective longitudinal axes of said camming members to move the trays up and down therealong while guided by the helically continuing threads;

said helically continuing threads being divided into a low pitch region in which each neighboring threads are spaced a small pitch and a high pitch region in which the neighboring threads are spaced an increased pitch, said first and second camming members being so supported with their high pitch regions confronting the sheet delivery station, said second high pitch region being of a size sufficient to allow one of the trays supported on the thread in the high pitch region to be manually upwardly shiftable.

5. The sheet sorting apparatus as claimed in claim 4, wherein each of said trays includes first and second roller elements carried thereby so as to protrude laterally from opposite sides of the respective tray, said roller elements rollingly resting on the helically continuing threads of the first and second camming members, respectively.

6. The sheet sorting apparatus as claimed in claim 4, further comprising a stapler mechanism for binding the sheets in each collated set together and a chucking mechanism for holding the respective collated set of the sheets to allow the stapler mechanism to staple the collated set of the sheets.

7. A sheet sorting apparatus of a moving bin type for sorting sheets received successively from a sheet delivery station into collated sets, which apparatus comprises:

a plurality of trays stacked one above the other in a vertical direction;

a frame structure by which the trays are vertically movably supported;

first and second camming members extending in a direction parallel to a direction of movement of the trays, each of said first and second camming members being in the form of an elongated cylinder having an outer peripheral surface helically fluted to leave helically continuing threads on such outer peripheral surface, each of said helically continuing threads having an upwardly oriented camming face on which the trays rollingly rest to thereby support the trays;

a sheet delivery mechanism for successively discharging the sheets towards the delivery station;

a drive motor drivingly coupled with the first and second camming members for driving the camming members about respective longitudinal axes of said camming members to move the trays up and down therealong while guided by the helically continuing threads;

said helicaily continuing threads being divided into a low pitch region in which each neighboring threads are spaced a small pitch and a high pitch region in which the neighboring threads are spaced an increased pitch, said first and second camming members being so supported with the high pitch region of the helically continuing threads thereof confronting the sheet delivery station, a groove between neighboring threads in said high pitch region having an increased width sufficient to allow one of the trays supported on the thread in the high pitch region to be manually upwardly shiftable.

8. The sheet sorting apparatus as claimed in claim 7, wherein each of said trays includes first and second roller elements carried thereby so as to protrude laterally from opposite sides of the respective tray, said roller elements rollingly resting on the helically continuing threads of the first and second camming members, respectively.

9. The sheet sorting apparatus as claimed in claim 7, further comprising a stapler mechanism for binding the sheets in each collated set together and a chucking mechanism for holding the respective collated set of the sheets to allow the stapler mechanism to staple the collated set of the sheets.

* * * * *